United States Patent [19]

Durville

[11] 4,137,728

[45] Feb. 6, 1979

[54] CAM TRACK FOR A CIRCULAR KNITTING MACHINE

[75] Inventor: Gerard Durville, Geneva, Switzerland

[73] Assignee: Vanguard Supreme Machine Corporation, Monroe, N.C.

[21] Appl. No.: 815,478

[22] Filed: Jul. 14, 1977

[30] Foreign Application Priority Data

Apr. 29, 1977 [CH] Switzerland ..... 5346/77

[51] Int. Cl.[2] ..... D04B 15/32

[52] U.S. Cl. ..... 66/57

[58] Field of Search ..... 66/57, 78

[56] References Cited

U.S. PATENT DOCUMENTS

| | | | |
|---|---|---|---|
| 1,056,691 | 3/1913 | Kimes | 66/57 |
| 2,067,733 | 1/1937 | Robaczynski | 66/57 X |
| 3,435,636 | 4/1969 | Lindner et al. | 66/57 |
| 3,673,818 | 7/1972 | Havranek et al. | 66/57 |
| 3,751,943 | 8/1973 | Schindele | 66/57 X |
| 3,922,886 | 12/1975 | Moyer | 66/57 X |
| 4,037,434 | 7/1977 | Durville et al. | 66/57 |

FOREIGN PATENT DOCUMENTS

| | | | |
|---|---|---|---|
| 2242169 | 3/1974 | Fed. Rep. of Germany | 66/57 |
| 1223317 | 2/1971 | United Kingdom | 66/57 |
| 1398602 | 6/1975 | United Kingdom. | |

OTHER PUBLICATIONS

Black, D. H. et al., Increasing the Rate of Fabric Production of Weft Knitting Machinery. Parts 1 & 2, in Journal Textile Instit. pp. 313–339, 1970.

*Primary Examiner*—Werner H. Schroeder
*Assistant Examiner*—Andrew M. Falik
*Attorney, Agent, or Firm*—Bell, Seltzer, Park & Gibson

[57] ABSTRACT

A closed cam track, characterized by curves corresponding essentially to the formula $Y = f(X^n)$ where Y is the axial displacement of needles in grooves of the track, X is the peripheral rotational displacement of the track at constant angular velocity and n is greater than or equal to 3, is provided for a circular knitting machine.

4 Claims, 5 Drawing Figures

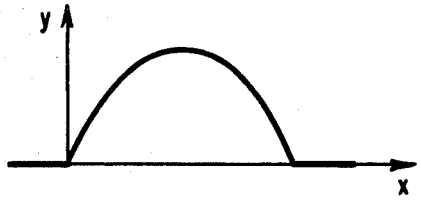
Fig. 1
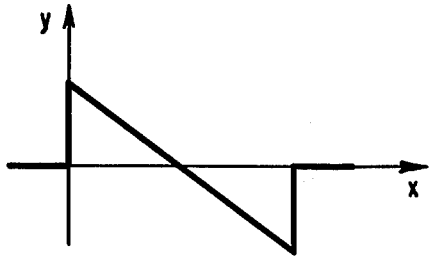
Fig. 2
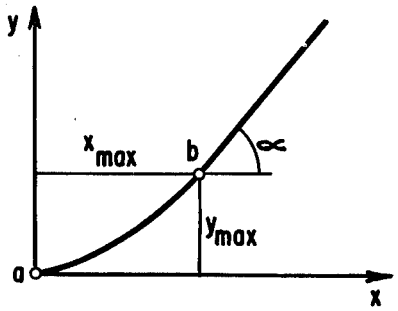
Fig. 3
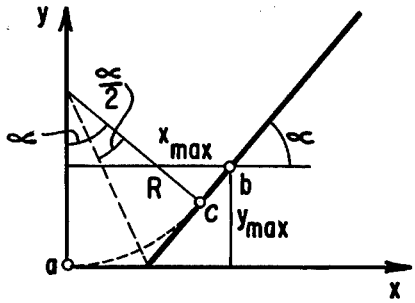
Fig. 4
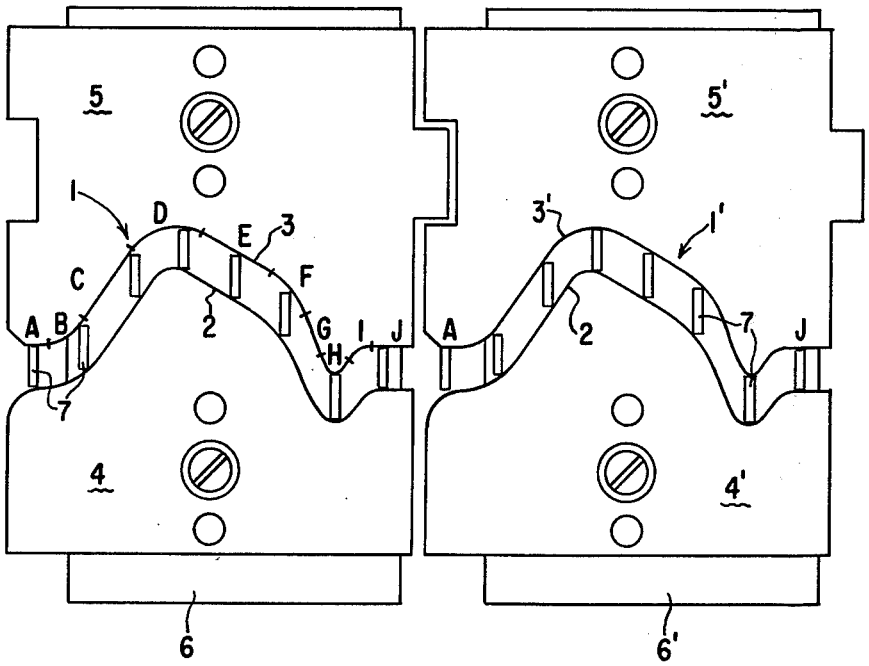

CAM TRACK FOR A CIRCULAR KNITTING MACHINE

BACKGROUND OF THE INVENTION

1. Field of the Invention

The invention relates to circular knitting and more particularly to closed track camming for such machines.

2. Description of the Prior Art

The increase of knitting rate of circular knitting machines is limited by the extent of acceleration and of acceleration changes to which the cams and needles are subjected as well as by the tractions applied to the yarn. The needle of a circular knitting machine is displaced at constant angular speed around the longitudinal axle of the needle bed and at variable speeds in a direction parallel to this axle. This variable speed is given to the needles by means of cams fastened around the needle bed. In the past, such cams were in the form of successively ascending and decending linear track sections linked by connecting portions wherein the needles had a degree of freedom. Each time a needle was actuated by such cam, it was subjected to a very high acceleration and to a nearly infinite acceleration change (pulse). These high values lead to rapid wear of the needle butts and limited the spinning of the needle bed to relatively low r.p.m.

One has already proposed to remedy these drawbacks by using cams forming a closed cam track for ensuring constant control of the needle displacements and by linking the ascending and descending track portions by arcuate portions. Such design reduces the accelerations to lower values and decreases the stresses experienced by the needles and the cams.

As a result, considerable improvements, for instance, lower wear of needles and cams as well as increased rotations rates were achieved.

As it is known from general theories in the art of cam making, curves corresponding to equations comprising 6th degree polynomials are capable of producing steady accelerations and acceleration changes. However, in the case of cams for knitting machines, although such types of solutions may first appear the most satisfactory regarding needle life, they are plagued by other drawbacks inherent to stitch formation and overtensions in the yarn. Further, such cam shapes will limit unacceptable the number of feeds/turn because of their size or they will require that very steep slopes be used (about 60° or more). It should also be recalled that although the influence of cam shape on yarn tensions and wear of needles and cams has been much investigated, the fact that cam track, which is formed by a plurality of cam track sections of track blocks separated from each other, is discontinuous should not be overlooked. Even if each cam track section is designed to steadily accelerate the needles, the passing of said needles from one cam track element to the following one will produce a sudden and possible significant change of speed. This results from the fact that, when passing from two adjoining elements, the needles are out of control for a short period. Their vertical movement during such period which is determined by the rubbing forces against the walls and the tension in the yarn cannot be controlled accurately with the result that, when reaching the next cam track portion, the needle undergoes an acceleration of undetermined magnitude. Consequently, even when using cam track sections for imparting steady acceleration changes to the needles, the latter may be subjected to large speed variation when passing from one track section to the next one. The present discussion is intended to show that it is not necessarily desirable that each cam section be calculated as a function of a steady acceleration variation if the needle is still subjected to knocks when jumping from one to the other track section.

SUMMARY OF THE INVENTION

The present invention remedies, at least partially, the drawbacks mentioned above, to ensure a substantial increase of the knitting rate and a minimum wear of needles and cams without increasing the traction or tension in the yarn.

Thus, the present invention is directed to an improved cam track for a circular knitting machine which comprises needles installed in a cylindrical supporting holder or needle cylinder rotatively mounted around a longitudinal axle, each needle being fitted so as to slide within a guiding groove directed peripherally along said holder and being provided with a butt protruding from said groove two sides of which, oriented perpendicular to said groove, engaging between two opposing cam surfaces supported on the machine frame, the surfaces defining together the improved cam track which is constituted by a plurality of successive cam track sections supported on blocks mounted side by side around the needle cylinder and comprising alternate rectilinear ascending and descending portions corresponding to a first and to a second axial speed of the needles respectively, such portions being connected by arcuate portions whereby the needles undergo changes from the first axial speed to the second axial speed and conversely. This cam track is characterized by the fact that the arcuate portions are curved to correspond essentially to the formula $$Y = f(X^n)$$

wherein Y is the axial displacement of the needles and X is the peripheral rotational displacement of said holder at constant angular velocity and n is greater than or equal to 3.

DESCRIPTION OF THE DRAWINGS

The annexed drawing illustrates schematically, and as an example, one embodiment of the cam track to the invention.

FIG. 1 is a diagram relative to acceleration produced by the cam track of the invention.

FIG. 2 is a diagram relative to the acceleration change involved in the process illustrated by FIG. 1.

FIGS. 3 & 4 are schematics for comparatively explaining the differences between circumferential arcs and polynomial curves.

FIG. 5 is a side view of two adjoining cam track sections.

DESCRIPTION OF THE INVENTION

In a circular knitting machine, the needles are slidingly fitted within grooves which are oriented axially around a cylindrical holder, called the needle bed or cylinder, rotatably mounted relative to its longitudinal axle.

During operation of the machine, the needles are subjected to two simultaneous orthogonally directed displacements. The horizontal circular motion is constant and depends on the circumferential speed of the needle bed. The vertical motion is alternating and its speed varies with the tangent of the slope of the cam track. The tangential velocity $V_t$ is calculated from the angle of this slope relatively to the peripheral displacement and the speed VR of the latter as follows:

$$V_t = VR/\cos\alpha$$

Consequently, the problem is to establish suitable acceleration relations whereby the machine parts are subjected to least forces, being given the vertical displacement of the needle and the angular space allowed for knitting one stitch.

Now, if the change from rectilinearly connected cam portions to arcuately connected ones has permitted decreasing considerably the maximal acceleration undergone by the cams, it still remains that the acceleration changes given by the derivative of the acceleration equation may take infinite values.

To better understand the mechanical consequences resulting from acceleration changes where applied to needles, it is appropriate to compare each needle butt cooperating with the cam track to a spring subjected to a force. If the force applied to such spring is increased very rapidly, the spring is suddenly compressed and starts vibrating because of the generated shock wave. If conditions for resonance exist, the vibrations can get amplified. Conversely, if the force vibration is slow, the spring behaves as a rigid body and no vibration kinetic energy is evolved. Consequently, if one desires to accelerate the needle with a minimum of vibration, one will have to consider the rate of change of acceleration in addition to this acceleration itself.

For obtaining acceptable acceleration variations, a method was developed on the basis of some polynomial equations of the form $$Y_t = C_o + C_1t + C_2t^2 + C_3t^3 + \qquad (1)$$

wherein $Y_t$ is the vertical displacement of the needle as a function of the time in an x, y coordinates system.

$C_o$, $C_1$, $C_2$, $C_3$ . . are constants calculated by algebraically developing such polynomial equation, the maximal acceleration time $t_{max}$ being defined as a distance $2a$ on the abcissa (axis of time).

When calculations were performed on the basis of a polynomial of the 6th degree, it was found that the curve thus obtained takes a lot of room with regard to the space available to knit one stitch. In such case, the number of feeds should have to be reduced.

A 4th degree polynomial was therefore used to develop a curve which retained acceptable acceleration and acceleration variation or pulse characteristics. As shown in FIG. 1, the change in acceleration (plotted on the y axis) with respect to time or position (plotted on the x axis) is continuous and contains no abrupt variations. In contrast, the acceleration diagram of a circular curve demonstrates an abrupt decrease from its maximum to zero when the needle leaves the circular portion of the track. This acceleration characteristic of circular curves is particularly undesirable because the abrupt change in acceleration occurs over an essentially instantaneous period of time. Thus, an essentially infinite pulse is created, i.e., at the point of abrupt changes in acceleration. Infinite pulses subject the needle to forces that increase wear of the needles and wear of the cam track.

In contrast to the circular curve, the pulse that results from the 4th degree polynomial curve contains acceptable characteristics. Thus, as illustrated in FIG. 2 where pulse or acceleration variation is plotted on the y axis and time or position on the x axis, the change in pulse remains within a maximum and at no time approaches infinity. The smooth and continuous acceleration gives rise to this phenomenon that is not present in curves of a lower degree. Abrupt changes in pulse are still present in 4th degree polynomial curves, but such would be eliminated in higher degree polynomial curves. As long as the pulse remains within a maximum, the wear of the needle and cam track can be controlled.

The constants of the above equation were calculated with the assumption that, in the case of two straight portions connected by a parabola, the "in" and "out" acceleration values are normally zero, and by using the following data:

Starting data

VR = peripheral velocity of the needle bed ($m.s^{-1}$)
ALE = angle of entrance of the curve relative to the direction of rotation (rad)
ALS = angle of exit of the curve relative to the direction of rotation (rad)
AM = maximum acceleration ($m.s^{-2}$)

CALCULATED DATA $2a$ = Abcissa value corresponding to $t_{max}$, i.e. max. acceleration time (s)
$C_1 = tg(ALE)\cdot VR$
$C_2 = 0$
$C_3 = AM/3a$
$C_4 = -AM/12a^2$
$C_5 = 0$
$C_6 = 0$
$a = 3VR[tg(ALS) - tg(ALE)]/4AM$ The general equation (1) then becomes $$Y_t = C_1t + C_3t^3 + C_4t^4 = VRtg(ALE)t + AMt^3/3a - AMt^4/12a^2$$

Then, with $X = VR.t$ (2)

$$Y_X = Xtg(ALE) + AMX^3/3a(VR)^3 - AMX^4/12a(VR)^4$$

This equation enables one to calculate the X and Y spatial coordinates for each point of the cam profile.

The limit value of Y is given for $$t_{max} = 2a \text{ or } X_{max} = VR.2a$$

$$Y_{Xmax} = 2aVRtg(ALE) + 8a^3AM(VR)^3/3a(VR)^3 - 16a^4AM(VR)^4/12a^2(VR)^4$$

$$Y_{Xmax} = 2a[VRtg(ALE) + 4/3aAM - 2/3aAM]$$

which simplifies to $$Y_{Xmax} = 3(VR)^2\,[tg(ALS) - tg^2(ALE)]$$

The corresponding horizontal displacement is from (2)

$$X_{max} = t_{max}\cdot VR = 3(VR)^2[tg(ALS) - tg(ALE)]/2AM$$

With $ALE = 0$, $ALS = \alpha$
AM = Av (vertical acceleration) and
An = acceleration component orthogonal to the cam track wall, $$Y_{max} = \frac{3(VR)^2 tg^2\alpha}{4Av} \quad X_{max} = \frac{3(VR)^2 tg\alpha}{2Av}$$

$$\text{with } Av = \frac{An}{\cos\alpha} \text{ and } An = \frac{3(VR)^2 tg\alpha\cos\alpha}{2X_{max}}$$

$$\text{Now } \frac{Y_{max}}{X_{max}} = \frac{tg\alpha}{2} \text{ i.e. } Y_{max} = \frac{X_{max} tg\alpha}{2}$$

$$\text{and } VR_{1max} = \sqrt{\frac{2X_{max}An}{3tg\alpha\cos\alpha}}$$

As illustrated in FIG. 3, wherein the axial and vertical displacement of the cam track is shown, the curve established on the basis of polynomial equations is suitable for smoothly and tangentially connecting point a and point b. Thus, if the cam track proceeds rectilinearly from left to right along the x axis, at point a the track will begin the polynomially defined curve, and at point b, the track again becomes rectilinear at an angle and with said x axis. At point a, the straight segment before (to the left of) a is tangent to the curved segment and, at point b, the straight segment after (extending upwardly from) b is tangent to the curved segment.

However, in the case of rectilinear segments joined by a simple circular curve, as illustrated in FIG. 4, smooth and tangential connection at points a and b is not usually possible. Thus, the circular arc to which the x axis is tangent at a will not be tangent to the sloped line after b at point b. In particular, the circular curved segment shown in dashed lines in FIG. 4 is tangent to the straight segments at points a and c, not points a and b which were to be joined. A circular segment can join points a and b, but no circular segment can join such points and be tangent to both straight segments.

Consequently, the circular segment cannot join two straight segments of different slopes in the most desirable manner. A needle entering or leaving a straight segment in other than a tangential manner will be subject to excessive acceleration and pulse. However, the polynomially defined curve permits the joining of two straight segments tangent at the points of intersection of the rectilinear and curved segments. The radius R of the circular arc will be $$R = X_{max}/2tg\alpha/2$$

Since the force Fn orthogonal to the wall on a mass m subjected to a circular motion of velocity Vt is $$Fn = mAn = mVt^2/R \quad \text{and}$$

substituting $Vt$ by the value given previously, one obtains $$Fn = mAn = m(VR)^2/R\cos\alpha \quad \text{i.e.}$$

$$VR_{2max} = \sqrt{R\cos^2\alpha\, An}$$

Using for R the value obtained above, one finds $$VR_{2max} = \sqrt{X_{max}\cos^2\alpha An/2tg\,\alpha/2}$$

$VR_{2max}$ being the maximum acceptable peripheral velocity in the case of cam track slopes connected by circular arcuate portions.

Then, the ratio $\eta_v$ between the maximum acceptable rotational speeds $VR_{1max}$ (polynomial curvatures) and $VR_{2max}$ is given by $$\eta_v = \frac{VR_{1max}}{VR_{2max}} = \sqrt{\frac{\frac{2X_{max}An}{3tg\,\alpha\cos\alpha}}{\frac{X_{max}\cos^2\alpha An}{tg\,\alpha/2}}}$$

which, with $tg\alpha/2 = \sin\alpha/1+\cos\alpha$ reduces to $$\eta_v = \sqrt{\frac{4\sin\alpha}{\frac{3(1+\cos\alpha)\sin\alpha\cos^3\alpha}{\cos^2\alpha}}} = \frac{2}{\sqrt{3}\cos\alpha}\sqrt{\frac{1}{1+\cos\alpha}}$$

Calculating $\eta_v$ as a function of $\alpha$ gives the following Table:

| $\alpha$ | $\eta v$ |
|---|---|
| 0° | 0.82 |
| 15° | 0.85 |
| 30° | 0.98 |
| 45° | 1.25 |
| 60° | 1.88 |
| 75° | 3.98 |

This shows that for $\alpha$ comprised between 45° and 55° which angles are commonly used, increases of needle bed rotation speeds of 25 to 70% for polynomial curved tracks are possible with same maximal load of the needle butt on the cam walls.

Then, the ratio $\eta_A$ of the orthogonal maximum accelerations corresponding to the polynomial and circular curvatures, respectively, can be calculated $$\eta_A = \frac{An_1}{An_2} = \frac{\frac{3(VR)^2 tg\alpha\cos\alpha}{2X_{max}}}{\frac{2(VR)^2 tg\alpha/2}{X_{max}\cos^2\alpha}}$$

$$\eta_A = (1/\eta_v)^2$$

Calculating $\eta_A$ for various values gives

| $\alpha$ | $\eta_A$ |
|---|---|
| 0° | 1.5 |
| 15° | 1.38 |
| 30° | 1.04 |
| 45° | 0.64 |
| 60° | 0.28 |
| 75° | 0.06 |

The above Table shows that with identical rotation velocities, the wear resulting from rubbing forces will be strongly decreased, with $\alpha > 30°$, when using polynomially curved tracks.

The above comparisons have been made with the assumption that the entrance angle was zero, i.e. that the vertical velocity was naught.

Now, the same calculations were performed with entrance and exit angles different from 0 and with given X and Y lengths. Then, $$\eta_v = \frac{VR_1}{VR_2} = \frac{\sqrt{\frac{2AvX}{3tg\alpha\cos\alpha}}}{\sqrt{\frac{3AnX\cos^2\alpha}{8tg\alpha/2}}}$$

-continued $$\eta_v = \frac{4}{3\cos\alpha}\sqrt{\frac{1}{1+\cos\alpha}}$$

from which the following table can be made

| $\alpha$ | $\eta v$ |
|---|---|
| 0° | 1.25 |
| 15° | 1.31 |
| 30° | 1.50 |
| 45° | 1.92 |
| 60° | 2.91 |
| 75° | 6.12 |

In such case, the speed increase obtained with systems based on polynomial curves is better than the increase calculated hereinbefore and is comprised between 2 and 3 times the speed permissible with circular arcuate systems when $\alpha$ is between 45° and 60°.

At equal rotation speeds in the two systems, the ratio of orthogonal accelerations becomes $$\eta_A = 9/16 \cos^2\alpha\,(1+\cos\alpha)$$

from which the following Table is calculated

| $\alpha$ | $\eta A$ |
|---|---|
| 0° | 1.12 |
| 15° | 1.03 |
| 30° | 0.78 |
| 45° | 0.48 |
| 60° | 0.21 |
| 75° | 0.05 |

Now, the performances that needles of a circular knitting machine must accomplish should be recalled.

Being given a cut and a stitch size, the needles must each knit such stitch on an as small as possible angular distance, at the highest possible rotation speed, with the lowest possible wear on the cams and the needles, and with the weakest or lowest possible stress or tension on the yarn.

By studying cams exlusively based on 6th degree or higher continuous polynomial curves it was shown that the steady acceleration variations obtained allow very high speeds. Such cams are however not practically adaptable to knitting problems for two main reasons:

First, such curves are wide and require that the number of feeds be reduced for a given needle bed circumference or it becomes necessary to raise the cam slopes to elevated values. Second, the average cam angle between the level of knock down of the stitch and the lower dead point of the needle is, either small which leads to much stress on the yarn because there are many strain points on this yarn from the needles which act simultaneously thereon, or greater which leads to less stress on the yarn but with slopes which should be as high as 60°. Now, such angles of slopes may equal or exceed the angle beyond which the efforts on the needle butts are excessive, namely when the machine is started.

Further, even with constant acceleration cam tracks, large acceleration changes still exist for the needle when passing from one cam track section to the next one, the whole track being formed by the plurality of blocks placed side by side around the needle bed and each section corresponding to one feed step. Therefore the stitch formation being related to several successive operations each of which being dependent on different parameters, it is important to keep acceleration variations under control but it is not necessary or even undesirable that such acceleration be perfectly steady.

It will be seen hereinafter that it may be advantageous in certain cases, to have different acceleration variations, and also to have constant velocity sections.

FIG. 5 gives as an Example the aspect of a cam profile which can be obtained with straight and polynomially curved segments; such cam track enables one to obtain high knitting speeds with acceptable limiting stresses for the yarns, cams and needles.

The cam track of FIG. 5 comprises two adjacent and identical sections 1 and 1' which form part of the total cam track and which are defined by two opposing cam surfaces 2 and 3, and 2' and 3' respectively, of two plates 4 and 5, and 4' and 5' respectively, fastened by pairs to two blocks 6 and 6' respectively, normally fitted on the supporting frame of the machine (not represented) around the needle bed. A plurality of needles, of which only the butts 7 are represented, engage with each of cam sections 1 and 1'.

Segments A and J of cam sections 1 and 1', each corresponding to one feed, are the entrance and exit portions of these sections; such portions are straight and give zero vertical speed to the needles. Taking into account that the needle is not under control when passing from one section to an adjacent one, it is only under such conditions of no vertical force on the needle that the latter can jump from one section to the next one without knocking against the walls of the track. This element is one of the essential features which result from combining constant speed rectilinear segments of the track with arcuate segments wherein the acceleration is controlled by suitable polynomially defined curves.

Such shape of cams presents three further interesting properties:

The rectilinear segment E corresponds to the closing of the needle latch. There the needle goes down, the stitch just formed meets the open latch and closes it to disengage from the needle. Since the yarn of the stitch is involved in the immediate nearness of the pivoting axle of the latch, the latter receives a motion when it is hit by the stitch during the needle fall. This motion accelerates instantaneously the latch in a manner proportional to the magnitude of speed of the needle, relative to the stitch, when it hits the latch. The energy communicated to this latch is thereafter damped when it closes against the needle hook tip. Therefore, this energy should be as small as possible to increase the needle useful life and the descending speed of the needle when the stitch meets the latch should be as low as possible. This is why the slope angle of segment E is reduced, on the order of 30 to 40 degrees. In addition, being given that, depending on the stitch length, the level position of the meeting position can vary, it is useful, when room is available, that segment E has a reasonable length.

After curved acceleration segment F, the cam has a straight segment G corresponding to the knock down level from which the needle pulls a new length of yarn for forming a new stitch. It is well known that such sequence is a critical event in the stitch formation cycle, particularly regarding yarn strain or tension. Effectively, the lower the average slope angle of the track between the knock down level and the lowest dead point, the greater the number of needles which simultaneously pull on the yarn, and the more the friction and tension is put on the yarn. With a steep average slope, but with a maximum not above around 55°, the braking rate of the needle should be relatively strong.

If, for a given speed VR and an incident or entrance angle $\alpha$, it appears from the formulae giving $X_{max}$ and $Y_{max}$ the ratio of X relative to Y does not depend on the acceleration, such values for X and Y are found to be conversely proportional to the acceleration value which results practically, for a given stitch size, in an important variation of the average slope.

In contrast, the lowest dead point (curved segment H) is followed by a relatively weak oppositely curved acceleration segment I for slowly releasing the strain on the yarn for limiting the time the yarn is held in the hook of the needle while in the lowest dead point, and for equalizing the stitch length.

In some cases, the room available is not sufficient for forming the segment E; therefore, in such case, one will have to only use a constant speed descending segment.

It should be further noted that the manufacture of cam profiles is achievable by means of electro-erosion techniques. Now, electro-erosion machines presently available are unable to machine pieces with continuously variable radius curves but are intended for achieving curves composed of a succession of circular arcuate segments of different centers and radii. In this fashion, it is quite possible to compute with a computer a proper succession of such circular arcs of appropriate curvature to satisfactorily approximate a theoretical curve obtained from the above polynomial calculations.

Certain advantages of the cam track of the present invention have already been stressed in the course of the present specification. It is however useful to again repeat the reasons why, in contrast with regular theories in the art of cams, discontinuous acceleration models have been selected to conform with the particular applications inherent to knitting. This selection has demonstrated that when relating the vertical amplitude of the needle displacement with a given angular space of a circular knitting system, one can markedly reduce the value of the slope angle which is a particularly important mechanical parameter, namely upon starting of the machine. By strongly decelerating the needle at the end of the descending step, a relatively large angle of the order of 40°–50° between the knock down level (lower end of straight segment G) and the lowest needle dead point (lower middle of curved segment H) can be achieved with a maximum slope not exceeding 55° which is considered a maximum acceptable slope.

This strong deceleration is followed by a relatively weak acceleration for limiting the yarn catch which follows the vanishing of the needle pull resulting from the movement inversion after the lowest dead point.

The needle butt being guided in a groove forming the cam, the deceleration areas generate vibrations which are specially strong as the deceleration is slow, as in the case of cams with continuous accelerations.

Finally, the jump from one cam section to the next one at zero vertical speed prevents knocks which occur in any other conditions.

Having thus described the nature of the invention, what is claimed herein is:

1. Improved cam track for a circular knitting machine which comprises needles installed in a needle cylinder supported on the machine frame for rotation around a longitudinal axle, each needle being fitted so as to slide within a guiding groove directed peripherally along said needle cylinder and being provided with a butt protruding from said groove and including upper and lower sides which are oriented perpendicular to said groove, said upper and lower sides of said butt engaging between two opposing cam surfaces supported on the machine frame, said opposing cam surfaces defining together said cam track which is constituted by a plurality of successive cam track sections mounted side by side around said needle cylinder and comprising alternate rectilinear ascending (C) and descending (E and G) portions corresponding to a first and to a second axial speed of the needles respectively, such portions being connected by arcuate segments whereby the needles undergo changes from the first axial speed to the second axial speed and conversely, said improved cam track being characterized by the fact that said arcuate segments (B, D, F, H and I) comprise curves defined by a polynomial equation of at least the third degree, wherein said polynomial curves join said ascending (C) and descending (E and G) rectilinear portions, and wherein the angle comprised between a line joining the lower end of said descending rectilinear portion (E and G) corresponding to the stitch knock-down level to the lowest dead point of the needle travel (bottom of curved cam segment H) is between 40° and 50°.

2. An improved cam track according to claim 1, including entrance and the exit segments (A and J) of each adjacent cam track section, and wherein said entrance and exit segments (A and J) are straight cam segments so that the angle of the same is zero with respect to the direction of rotation of the needle cylinder.

3. Improved cam track for a circular knitting machine which comprises needles installed in a needle cylinder supported on the machine frame for rotation around a longitudinal axle, each needle being fitted so as to slide within a guiding groove directed peripherally along said needle cylinder and being provided with a butt protruding from said groove and including upper and lower sides which are oriented perpendicular to said groove, said upper and lower sides of said butt engaging between two opposing cam surfaces supported on the machine frame, said opposing cam surfaces defining together said cam track which is constituted by a plurality of successive cam track sections mounted side by side around said needle cylinder and comprising alternate rectilinear ascending (C) and descending (E and G) portions corresponding to a first and to a second axial speed of the needles respectively, such portions being connected by arcuate segments whereby the needles undergo changes from the first axial speed to the second axial speed and conversely, said improved cam track being characterized by the fact that said arcuate segments (B, D, F, H and I) comprise curves defined by a polynomial equation of at least the third degree, said polynomial curves joining said ascending (C) and descending (E and G) rectilinear portions, and wherein said descending portion of each of said cam track sections includes two rectilinear segments (E and G) connected to each other by one of said curved segments (F), and wherein the descending angle of the upper rectilinear segment (E) is substantially less than the descending angle of the lower rectilinear segment (G).

4. An improved cam track according to claim 3 wherein the descending angle of the upper rectilinear segment (E) is between 30 and 40 degrees.

* * * * *